US010100445B2

(12) United States Patent
Turner

(10) Patent No.: US 10,100,445 B2
(45) Date of Patent: Oct. 16, 2018

(54) METHOD OF FORMING A UNITARY KNIT ARTICLE USING FLAT-KNIT CONSTRUCTION

(71) Applicant: NIKE, Inc., Beaverton, OR (US)

(72) Inventor: David Turner, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 860 days.

(21) Appl. No.: 14/244,344

(22) Filed: Apr. 3, 2014

(65) Prior Publication Data

US 2015/0284885 A1 Oct. 8, 2015

(51) Int. Cl.
*D04B 1/24* (2006.01)
*D04B 21/20* (2006.01)

(52) U.S. Cl.
CPC ..... *D04B 1/246* (2013.01); *D04B 21/207* (2013.01)

(58) Field of Classification Search
CPC ..... D04B 1/246; D04B 21/207
See application file for complete search history.

(56) References Cited

U.S. PATENT DOCUMENTS 2,000,073 A * 5/1935 Goas ..... A41B 9/001 2/407
2,004,699 A * 6/1935 Krautkopf ..... D04B 1/00 66/179
2,072,050 A * 2/1937 Sharps ..... A41D 1/04 2/90
2,403,793 A 7/1946 Feinstein
2,406,969 A * 9/1946 Silman ..... D04B 1/24 450/131
2,575,700 A 11/1951 Artzt
2,643,532 A * 6/1953 Sandri ..... D04B 1/22 66/172 E
3,013,276 A 12/1961 Maxwell
3,078,699 A * 2/1963 Huntley ..... A41D 1/04 2/115
3,474,643 A * 10/1969 Chell ..... D04B 1/246 66/176
3,500,665 A * 3/1970 Schoffner ..... A41C 3/0014 450/70
3,561,009 A 2/1971 Huggins
(Continued)

FOREIGN PATENT DOCUMENTS

CN 2711199 Y 7/2005
CN 201204941 Y 3/2009
(Continued)

OTHER PUBLICATIONS

International Search Report and Written Opinion dated May 13, 2015 in International Application No. PCT/US2015/017204.
(Continued)

*Primary Examiner* — Danny Worrell
(74) *Attorney, Agent, or Firm* — Shook, Hardy and Bacon LLP

(57) ABSTRACT

A method for manufacturing an article of apparel from a singular knit component in disclosed. According to techniques described herein, multiple tubular knit components may be formed in succession, and as run of knit components, by a standard flat-knit machine. Thereafter, the knit components may be separate from each other, and portions of the knit components may be removed to transform each knit component into an article of apparel.

14 Claims, 13 Drawing Sheets

(56) References Cited

U.S. PATENT DOCUMENTS 3,664,156 A 5/1972 Betts et al.
3,668,896 A * 6/1972 Betts ..... D04B 7/32 66/176
3,668,901 A * 6/1972 Betts ..... D04B 1/24 66/176
3,695,063 A * 10/1972 Betts ..... D04B 7/32 66/176
3,796,068 A * 3/1974 Betts ..... A41D 27/10 66/176
3,813,901 A * 6/1974 Betts ..... D04B 1/246 66/176
3,882,697 A * 5/1975 Betts ..... D04B 1/24 66/176
3,956,908 A * 5/1976 Betts ..... D04B 7/30 66/175
4,040,275 A * 8/1977 Castello ..... D04B 1/246 66/170
4,095,441 A * 6/1978 Robinson ..... D04B 1/246 66/176
4,102,155 A * 7/1978 Robinson ..... D04B 1/246 66/176
4,107,955 A * 8/1978 Robinson ..... A41B 9/06 66/176
4,111,008 A 9/1978 Robinson et al.
4,197,724 A * 4/1980 Robinson ..... D04B 1/108 66/176
4,698,849 A 10/1987 Mitchell et al.
5,081,854 A * 1/1992 Lonati ..... A41B 9/00 2/402
5,388,430 A * 2/1995 Essig ..... D04B 1/246 66/176
5,452,592 A * 9/1995 Kobata ..... D04B 1/106 66/176
5,584,197 A * 12/1996 Okuno ..... D04B 1/24 66/172 R
5,775,133 A * 7/1998 Nilsson ..... D04B 1/246 66/171
6,308,536 B2 * 10/2001 Roell ..... D04B 1/22 66/64
6,327,711 B1 12/2001 Fujiwara
6,330,814 B1 * 12/2001 Fujiwara ..... D04B 1/24 66/121
6,389,850 B1 * 5/2002 Fujiwara ..... D04B 1/24 66/171
6,401,498 B1 * 6/2002 Fujiwara ..... A41D 27/10 2/243.1
6,550,284 B2 * 4/2003 Okamoto ..... D04B 1/246 66/176
6,668,593 B2 * 12/2003 Okamoto ..... D04B 1/24 66/176
6,739,159 B2 5/2004 Sciacca
6,766,666 B2 * 7/2004 Okamoto ..... D04B 1/24 66/176
7,181,309 B2 * 2/2007 Kazuyoshi ..... D04B 1/246 66/176
7,212,881 B2 * 5/2007 Kazuyoshi ..... A41D 1/04 66/176
7,458,237 B2 * 12/2008 Lonati ..... D04B 1/108 66/176
7,739,886 B2 * 6/2010 Okamoto ..... A41D 1/04 66/176
D630,819 S 1/2011 Axler
8,176,570 B2 5/2012 Bedard et al.
8,286,268 B2 10/2012 Yamashita et al.
2005/0247083 A1 * 11/2005 Miyai ..... D04B 1/28 66/176
2010/0242158 A1 9/2010 Blakely et al.
2012/0023648 A1 2/2012 Dainese et al.
2012/0102618 A1 5/2012 Burmeister et al.

FOREIGN PATENT DOCUMENTS

EP 1091033 4/2001
EP 1864582 12/2007
JP 2001115310 A 4/2001
JP 2004218121 8/2004

OTHER PUBLICATIONS

International Preliminary Report on Patentability dated Oct. 13, 2016 in International Patent Application No. PCT/US2015/017204, 7 pages.

* cited by examiner

METHOD OF FORMING A UNITARY KNIT ARTICLE USING FLAT-KNIT CONSTRUCTION

BACKGROUND

Articles of apparel may incorporate features that both enhance the appearance or functionality of the apparel as well as streamline manufacturing of the apparel. Shirts, for example, may be enhanced by incorporating features to keep a wearer warmer, cooler, or to allow for ease of removal, among other things. Shirts may also be designed to streamline the manufacture of the shirt and at the same time provide structural details that directly affect ornamentation or a specific functional aspect of the shirt, such as tensile stretch. The present disclosure relates generally to a method of forming a unitary knit article using flat-knit construction techniques.

SUMMARY

According to aspects set forth herein, a method for manufacturing an article is disclosed. In particular, techniques for forming an article of unitary knit construction using a standard knitting machine are disclosed. Articles produced according to techniques herein may be produced in succession to bring efficiencies to the manufacturing process as well as to enhance functional qualities of the articles being produced.

In one aspect, the disclosure provides a method for manufacturing an article of apparel that includes forming a first region comprised of a first tubular flat knit element and forming a second region comprised of a first set of multiple tubular flat knit elements. The second region is adjacent to the first region and extends outward from the first region and is formed of a singular knit construction, wherein the first region and the second region together form a first knit component. Next, at least a portion of the first set of multiple tubular flat knit elements is cut off to create a pair of arm holes, a top portion of the first region is cut off to create a pair of shoulder regions, and a center portion of the first region is cut to create a neck hole.

In another aspect, the disclosure provides a method of manufacturing multiple articles including forming a plurality of knit components on a flat knitting machine, each of the plurality of knit components comprising a first region and a second region. The first region is comprised of a tubular flat knit element. The second region is comprised of multiple tubular flat knit elements, and the second region is adjacent to the first region and extends outward from the first region. The first region and the second region are formed of a singular knit construction. Next, each of the plurality of knit components is separated into a plurality of individual knit components. For each of the plurality of individual knit components, at least a portion of the multiple tubular flat knit elements are cut off to create a pair of arm holes; a top portion of the first region is cut off to create a pair of shoulder regions; and a center portion of the first region is cut off to create a neck hole.

In yet another aspect, the disclosure provides a method for manufacturing a football jersey. The method includes forming an upper torso region comprised of a first tubular flat knit element and forming a lower torso region comprised of multiple tubular flat knit elements. Further, the lower torso region is adjacent to the upper torso region and extends outward from the upper torso region and is formed of a singular knit construction. Still further, the upper torso region and the lower torso region together form a singular knit component. Next, at least a portion of the first set of multiple tubular flat knit elements is cut off to create a pair of arm holes, a top portion of the first region is cut off to create a pair of shoulder regions, and a center portion of the first region is cut off to create a neck hole.

Other systems, methods, features and advantages of the disclosure will be, or will become, apparent to one of ordinary skill in the art upon examination of the following figures and detailed description. It is intended that all such additional systems, methods, features and advantages be included within this description and this summary, be within the scope of the disclosure, and be protected by the following claims.

BRIEF DESCRIPTION OF THE DRAWINGS

The disclosure can be better understood with reference to the following drawings and description. The components in the figures are not necessarily to scale, emphasis instead being placed upon illustrating the principles of the disclosure. Moreover, in the figures, like reference numerals designate corresponding parts throughout the different views.

DETAILED DESCRIPTION

The present disclosure sets forth a variety of concepts relating to knitted articles and the manufacture of knitted components. Although knitted components produced using the techniques described herein may be utilized in a variety of products, a shirt is disclosed below as an example. In addition to shirts, the knitted components may be utilized in other types of apparel (e.g., footwear, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components, techniques and other concepts disclosed herein may be incorporated into a variety of products for both personal and industrial purposes.

Article Configuration

Figure 1:
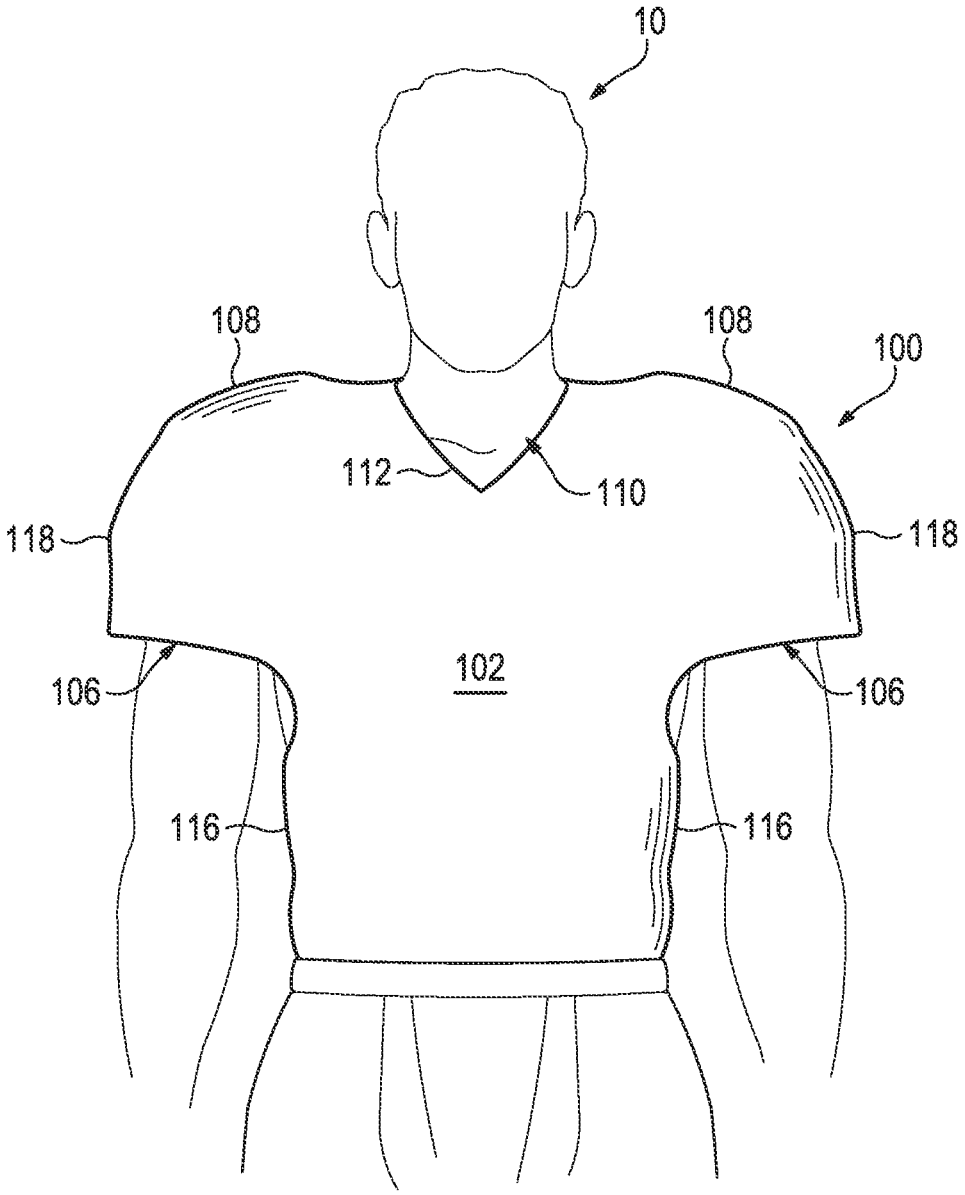
FIG. 1 is an elevational view of an article of apparel.
Figure 2B:
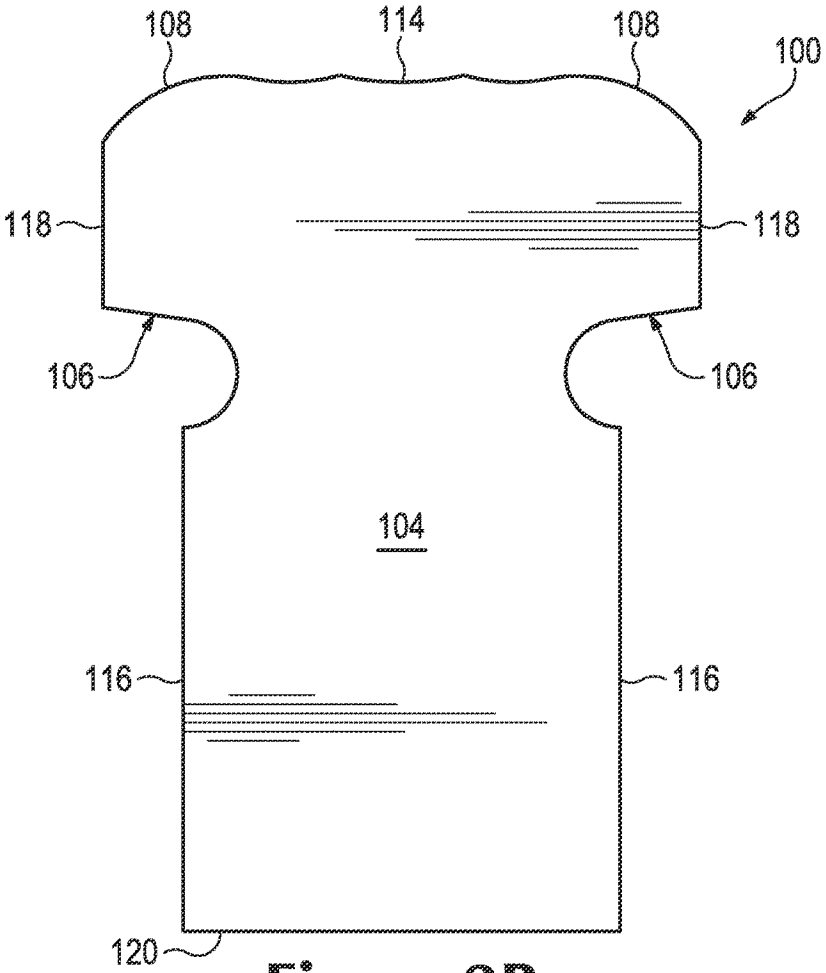
FIG. 2B is a rear elevational view of the article of apparel.
Figure 2A:
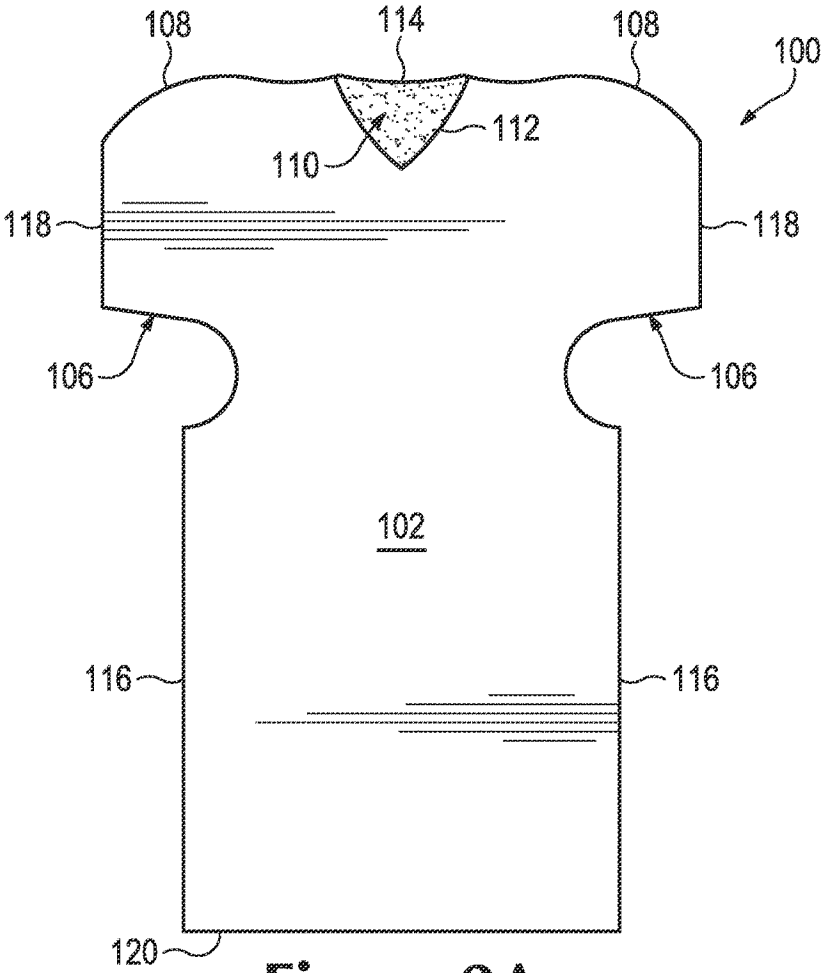
FIG. 2A is a front elevational view of the article of apparel.

FIGS. 1 and 2A-2B depict an article of apparel, hereinafter referred to as shirt 100, that may be manufactured according to unitary knitting techniques disclosed herein. FIG. 1 is an elevational view of shirt 100 on individual 10 and FIGS. 2A and 2B are a front elevational view and a rear elevational view, respectively, of shirt 100 as the article might lay on a flat surface. Referring to FIGS. 1 and 2A-2B, the primary components of shirt 100 are a front torso portion 102, a rear torso portion 104, a pair of side portions 116 and a pair of arm portions 118. According to aspects described herein, portions of shirt 100 may be formed using unitary knitting techniques, such as the flat-knitting technique set forth below. In some cases, portions of shirt 100 may be separately knitted and joined at various seams, e.g., along a side seam or a shoulder seam. In other cases, portions of shirt 100 may be unitarily knitted to minimize seams that must be subsequently joined, and to create one or more surfaces that mold around a wearer's body. In at least one case, front torso portion 102, rear torso portion 104, pair of side portions 116 and pair of arm portions 118 may be unitarily formed as a single knitted component.

Referring to FIGS. 1 and 2A-2B, shirt 100 includes a front torso portion 102, a rear torso portion 104, pair of side portions 116 and pair of arm portions 118. As discussed in more detail below in relation to the manufacture of shirt 100, front torso portion 102 may be uniformly joined with rear torso portion 104 at pair of side portions 116 and pair of arm portions 118. In particular, because front torso portion 102 and rear torso portion 104 may comprise a unitary knitted article, side portions 116 and arm portions 118 may be unitary with front torso portion 102 and rear torso portion 104. Thus, whereas front torso portion 102 and rear torso portion 104 may correspond with a front torso and rear torso of a wearer, respectively, and cover at least a portion of the torso when worn, pair of side portions 116 and arm portions 118 correspond with the lateral torso area and upper arms of a wearer, respectively. Accordingly, pair of side portions 116 cover at least a portion of the lateral torso area of a wearer and pair of arm portions 118 cover at least a portion of each arm (e.g., an upper arm) when worn.

Front torso portion 102 and rear torso portion 104 of shirt 100 may also come together over a wearer's shoulders at a pair of shoulder portions 108. Shoulder portions 108 may be joined in a variety of ways, including but not limited to a traditional sewn seam, by adhesive or by other techniques known in the art. In at least one case, shoulder portions 108 may be created during the flat-knit manufacture of a shirt 100. In particular, during knitting, the yarns forming front torso portion 102 and the yarns forming rear torso portion 104 may be looped together to create a seam or a pair of shoulder portions 108. Aspects of the knitting process will be described in further detail below.

Front torso portion 102 and rear torso portion 104, joined at pair of side portions 116, pair of arm portions 118 and pair of shoulder portions 108, define various openings in shirt 100. In particular, front torso portion 102 and rear torso portion 104 together form a waist opening 120 and an opposite neck opening 110, having a front neck opening shape 112 and a rear neck opening shape 114. Further, pair of arm portions 118 form a pair of arm openings 106. When shirt 100 is worn, the wearer's neck/shoulder area may protrude through neck opening 110; the wearer's waist or pelvic area may protrude through waist opening 120; and the wearer's arms may protrude through arm openings 106.

Knitted Component Configuration

Shirt 100 may be formed using a variety of knitting methods and configurations. In some cases, shirt 100 may be formed from multiple separately knitted components that are joined together at seams. In other cases, shirt 100 may be cut from a standalone knitted component. In still other cases, multiple shirts similar to shirt 100 may be formed from a run of multiple knitted components. As will be discussed in more detail below, in at least one case, multiple shirts similar to shirt 100 may be cut from back-to-back knitted tubular components such as portion of knitted component run 400 depicted in FIGS. 3A-3B.

Figure 3A:
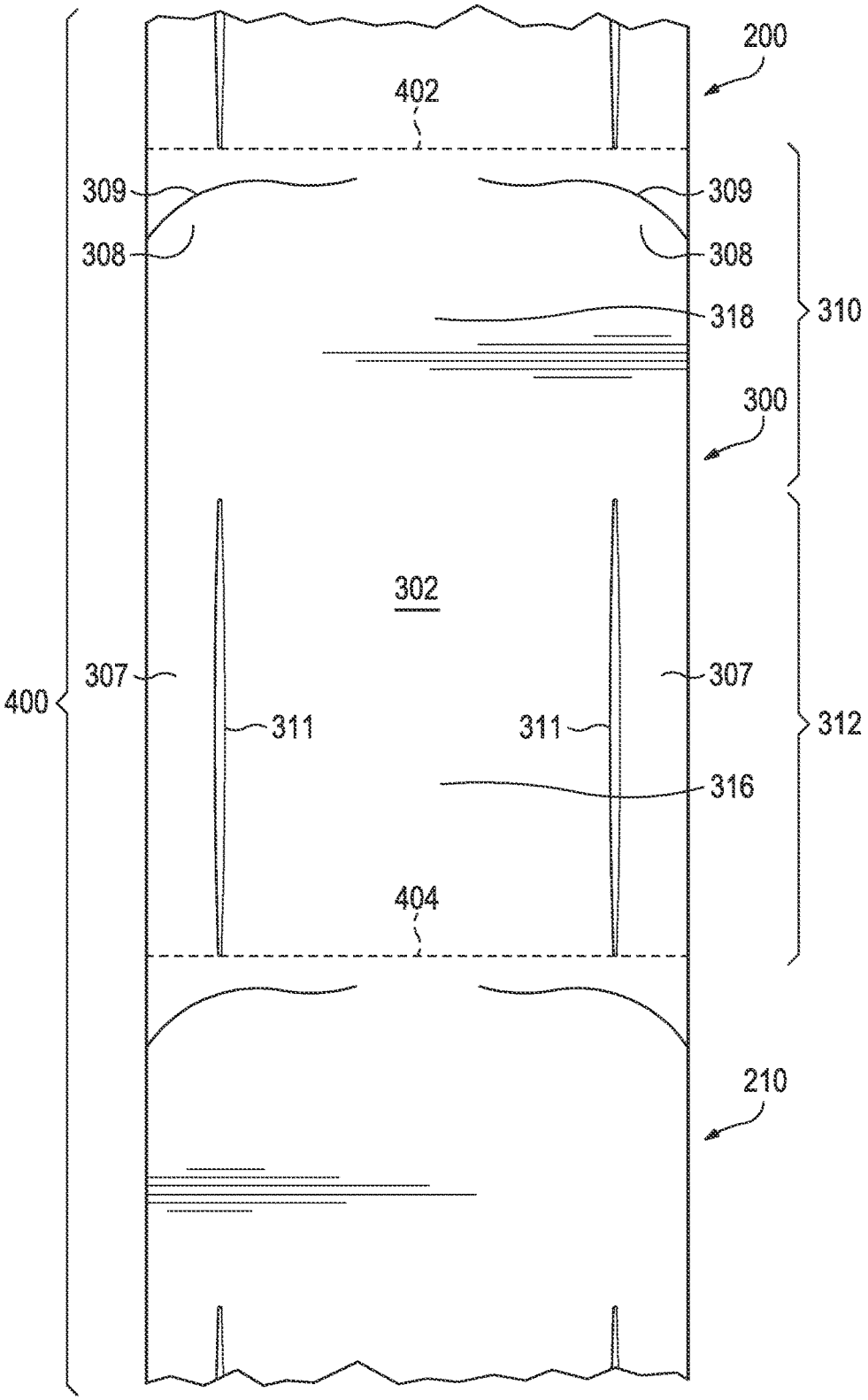
FIG. 3A is a front elevational view of a knitted component run comprising multiple articles.
Figure 3B:
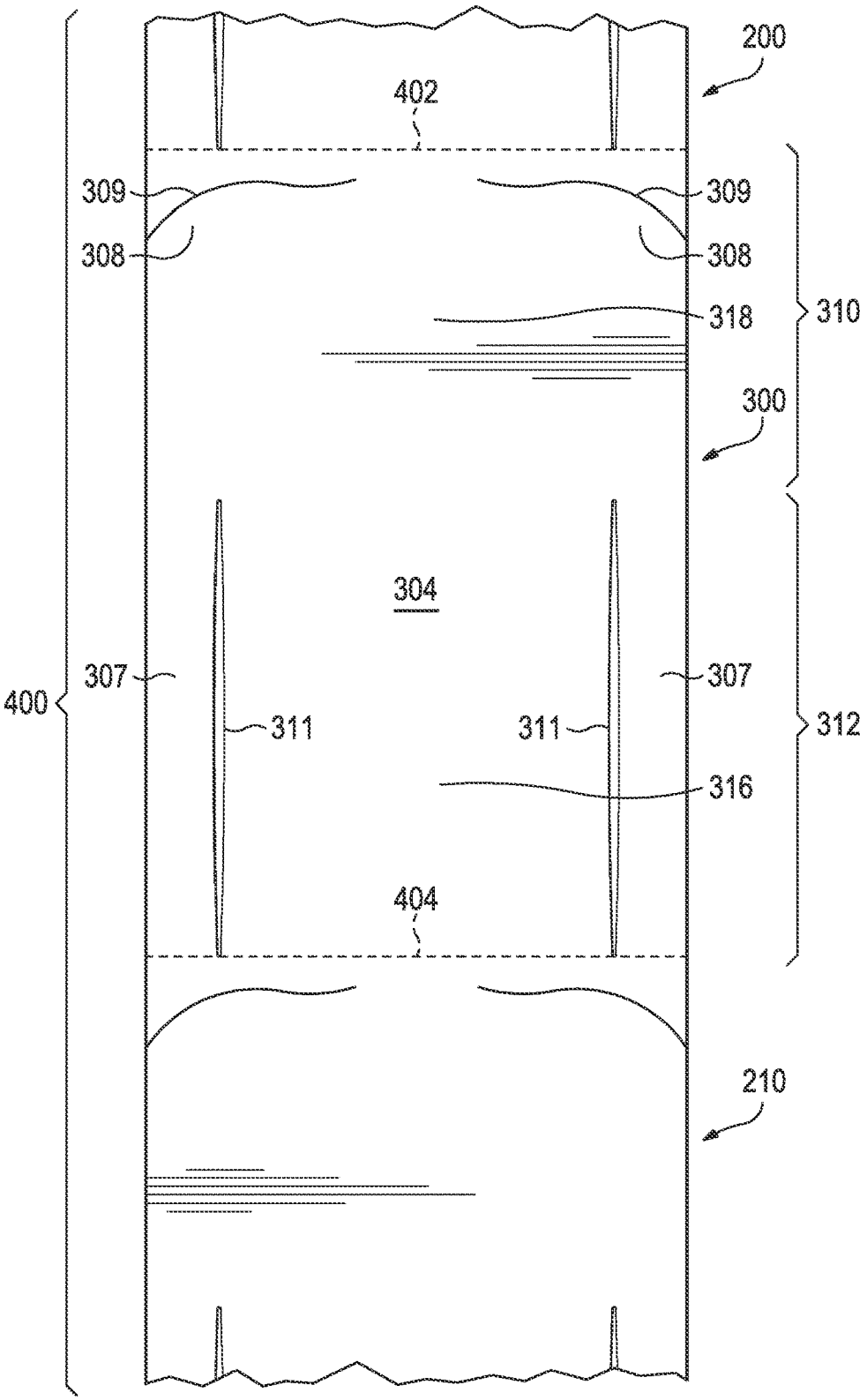
FIG. 3B is a rear elevational view of a knitted component run comprising multiple articles.

According to aspects described herein, a knitted tubular component run may refer to multiple back-to-back knitted tubular components, as the components are knitted and emerge from a flat-knit machine. Referring to FIGS. 3A-3B, a portion of knitted component run 400 depicts three integrally knitted tubular components, i.e. knitted component 200 (only a portion of which is shown), knitted component 300, and knitted component 210 (only a portion of which is shown). While the back-to-back knitted components of a knitted component run for producing multiple copies of a particular article—such as shirt 100 as disclosed herein—may be largely the same, for purposes of discussion, knitted component 300 will be referenced in detail.

Figure 4A:
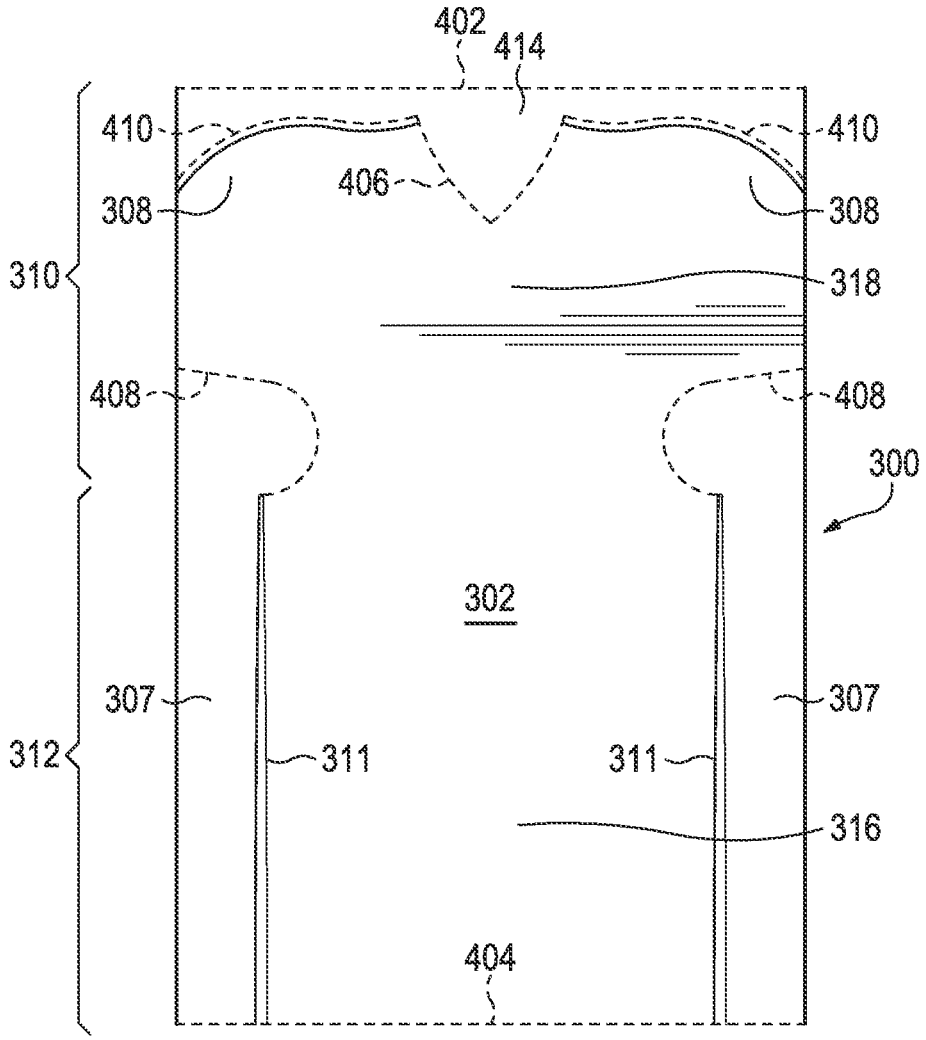
FIG. 4A is a front elevational view of a knitted component corresponding to an article of apparel.
Figure 4B:
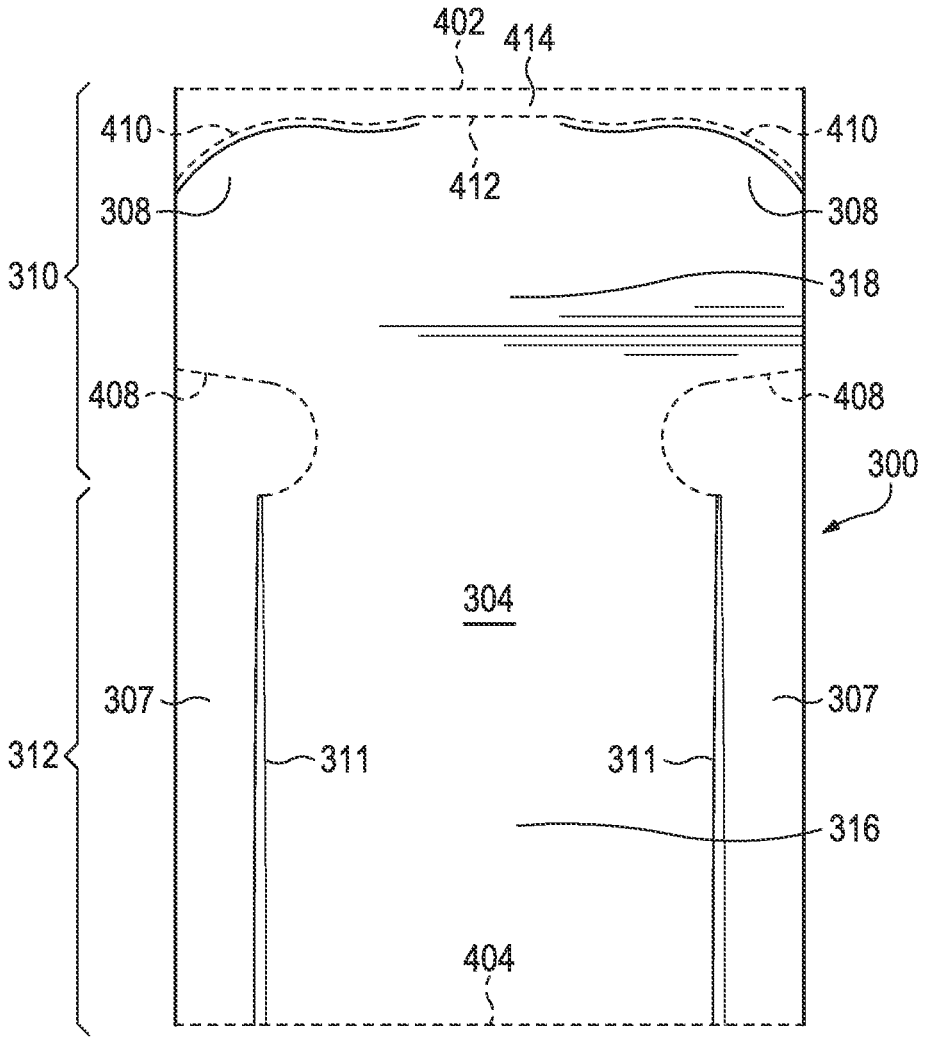
FIG. 4B is a rear elevational view of a knitted component corresponding to an article of apparel.

Knitted component 300, depicted as one of multiple tubular components in a portion of knitted component run 400 in FIGS. 3A and 3B, may serve as the basis of a unitarily formed shirt, such as shirt 100. In particular, in some cases, knitted component 300 may be separated from portion of knitted component run 400 by cutting or otherwise separating the knitted yarns along cut line 402 and cut line 404. FIGS. 4A and 4B depict a front portion 302 and a rear portion 304, respectively, of knitted component 300 after separation from portion of knitted component run 400. In other cases, however, a singular knitted component 300 may be produced, without the need for separation from multiple components in a knitted component run.

In some cases, a knitted component, such as knitted component 300, may be comprised of a single knitted element. In other cases, knitted components may be comprised of multiple separately knitted elements that are joined together to form a singular knitted component. In at least one configuration, as seen in FIGS. 3A-4B, knitted component 300 may be comprised of an upper torso region 310 comprising a unitary tubular element 318 and a lower torso region 312 comprising multiple tubular elements, or tubular element 316 and pair of tubular elements 307. Further, upper torso region 310 and lower torso region 312 may be produced in a continuous line or of a singular knit construction such that there are no breaks in the knitting process, and no seams are required to maintain their adjacency. Further, while unitary tubular element 318, tubular element 316 and tubular elements 307 may lay flat when emerging from a flat-knit machine, they may be shaped into hollow tubular elements, with a space in each tubular element between front portion 302 and rear portion 304.

Knitted component 300 may also comprise pair of shoulder seams 309 in shoulder region 308. Shoulder seams 309 may be formed during the knitting process (discussed in detail below), and occur when yarns associated with front portion 302 are looped with yarns associated with rear portion 304 such that the yarns of front portion 302 and rear portion 304 are connected at shoulder seams 309. Thus, while the multiple tubular elements associated with knitted component 300 may be hollow, unitary tubular element 318 may be joined in shoulder region 308 at shoulder seams 309 to create the shoulder seams of a shirt. In still other configurations, shoulder seams 309 may be added after the knitting process is complete by any means contemplated in the art, such as by a traditional stitched seam, by a heat process or by use of an adhesive.

Knitted component 300, or shirt 100, may be constructed of various fibers known in the art of apparel. In some cases, shirt 100 may be formed from synthetic fibers such as polyester. In other cases, shirt 100 may be formed from a blend of synthetic and natural fibers. In at least one case, shirt 100 may be formed using a polyester fiber blended with other fibers to impart stretch and recovery. For example, to provide stretch and recovery, elastane fibers, available from E.I. duPont de Nemours Company under the LYCRA trademark, may be incorporated into a knit fabric. In addition to or as a substitution for the polyester and elastane fibers, other fibers such as cotton or wool, natural filaments such as silk, and synthetic filaments such as rayon, nylon, and acrylic, may be utilized. The characteristics of the yarns selected for knitting shirt 100 depend primarily upon the composition of the various filaments and fibers of the yarns. Cotton, for example, provides a soft hand, natural aesthetics, and biodegradability. Elastane provides stretch and recovery. Rayon provides high luster and moisture absorption. Wool also provides high moisture absorption, in addition to insulating properties. Nylon is a durable and abrasion-resistant material with high strength, and polyester is a hydrophobic material that also provides relatively high durability. Accordingly, the materials comprising the fibers may be selected to impart a variety of physical properties to shirt 100, in addition to functional aspects provided by the structure and drape of shirt 100.

Shirt 100, constructed according to techniques described herein, may provide provisions for use in athletic endeavors. For example, the unitary construction of the tubular elements 307, 316 and 318 allow the respective portions of a shirt 100 to easily stretch around a wearers body and any additional padding that may be required for a sport, such as football padding, compression padding, or heat elements, to name a few. The ease of stretch may help a wearer when putting on or taking off shirt 100. Further, when constructed of a material with a certain level of stretch and recovery, the unitary knit construction of shirt 100 may provide equal recovery force across all areas of a wearer's torso.

Conversion to Article of Apparel

While the overall configuration of knitted component run 400 and knitted component 300 has been described, the manner in which knitted component 300 may be converted into an article of apparel, such as shirt 100 will now be described. First, a knitted component run 400 may be removed from a knitting machine and separated into singular knitted components, such as knitted component 300. For example, referring to FIGS. 4A and 4B, knitted component 300 may be separated or cut apart from knitted component run 400 at cut line 402 and at cut line 404.

Next, tubular elements 307 may be separated or cut off of knitted component 300 at arm cut lines 408. Once removed, arm holes 106 are created in tubular element 318. Next, the top portion 414 of knitted component 300 may be separated or cut away at shoulder cut lines 410. Again, once removed, shoulder seams 309 are made prominent. Finally, a neck opening 110 may be created by cutting front neck cut line 406 and rear neck cut line 412 on front portion 302 of knitted component 300 and rear portion 304 of knitted component 300, respectively, thereby removing the entirety of top portion 414. Once removed, the remaining portion of knitted component 300 may resemble shirt 100.

While various embodiments have been described in detail, those of skill in the art will appreciate that shirt 100 may be configured in a number of different ways and still fall within the spirit and scope of the present disclosure. For example, it is contemplated that all or a portion of tubular elements 307 may remain connected to knitted component 300, thereby imparting longer sleeves to a shirt 100. Further, neck opening 110 may be configured in a variety of shapes and sizes to accommodate different uses of shirt 100.

It is also further contemplated that a finish treatment may be applied to the various seams and or openings of the article constructed according to techniques described herein. For example, seams or openings may be finished with stitching, adhesive or with the addition of an overlay material, as would be contemplated by a skilled artisan.

Shirt 100, manufactured according to techniques described herein, may include provisions to accommodate stretching and rounding of various areas around a wearer and/or a wearer's undergarments, such as sports pads. For example, because side portions 116 and arm portions 118 are not held together by a traditional seam and instead are formed of tubular knit elements, side portions 116 and arm portions 118 may stretch to accommodate and conform to a wearer's torso and/or undergarments. Additionally, shoulder seams 309 may be configured and/or shaped to allow for additional stretch, for example, to easily stretch around football shoulder pads. Further, a wearer may shirt 100 easier to put on and remove due to the added flexibility in the side and arm/shoulder areas.

Knitting Machine Configuration

Figure 5:
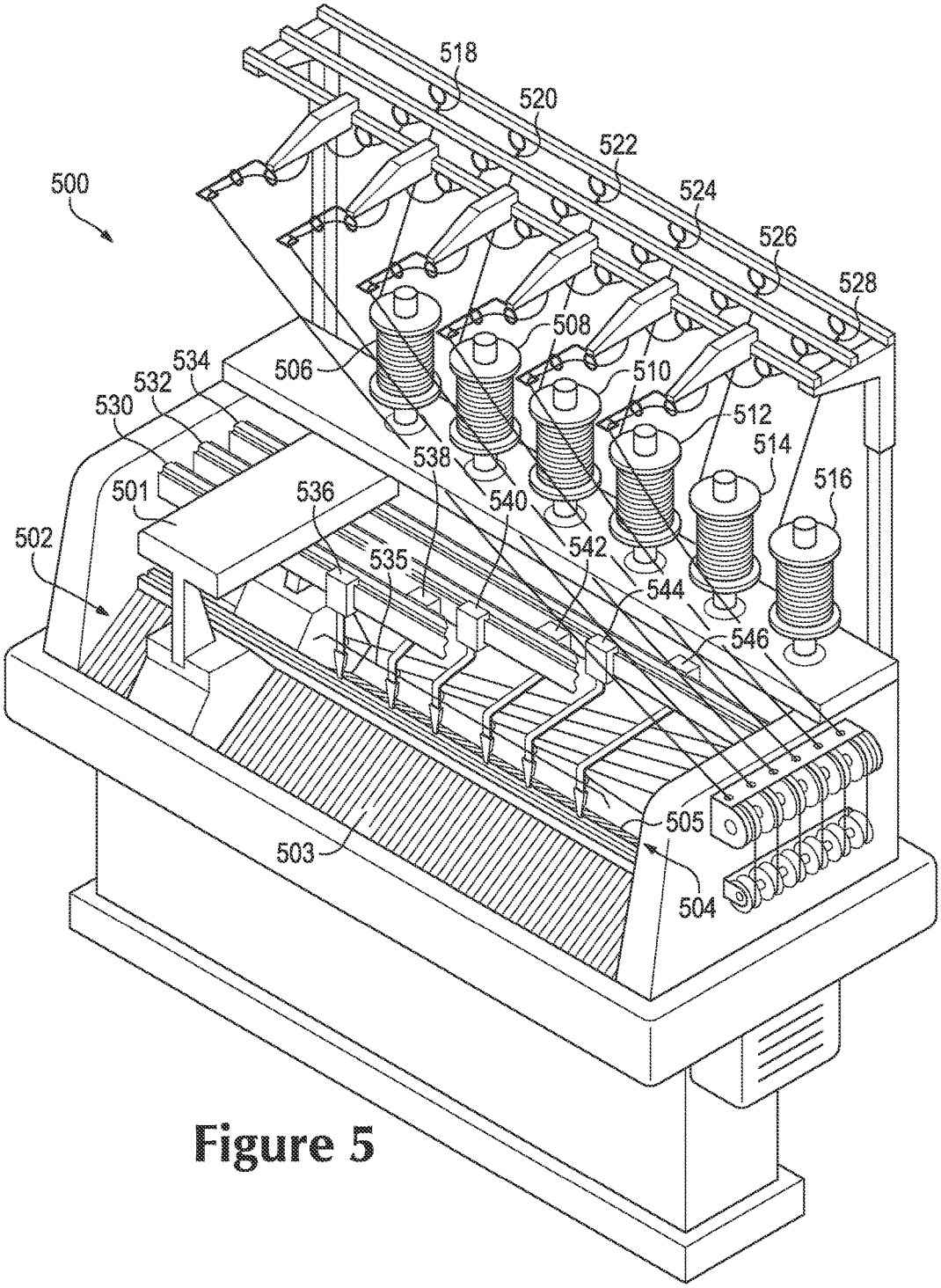
FIG. 5 is a perspective view of a knitting machine.

Although knitting may be performed by hand, the commercial manufacture of knitted components is generally performed by knitting machines. An example of a knitting machine 500 that is suitable for producing either of knitted component run 400 and individual knitted component 300 is depicted in FIG. 5. Knitting machine 500 has a configuration of a V-bed flat knitting machine for purposes of example, but either of knitted component run 400 or individual knitted component 300 may be produced on other types of knitting machines.

Knitting machine 500 includes two needle beds 502 and 504 that are angled with respect to each other, thereby forming a V-bed. Each of needle beds 502 and 504 include a plurality of individual needles 503 and 505, respectively, that lay on a common plane. That is, needles 503 from one needle bed 502 lay on a first plane, and needles 505 from the other needle bed 504 lay on a second plane. The first plane and the second plane (i.e., needle bed 502 and needle bed 504) are angled relative to each other and meet to form an intersection that extends along a majority of a width of knitting machine 500. As described in greater detail below, needles 503 and needles 505 each have a first position where they are retracted and a second position where they are extended. In the first position, needles 503 are spaced from the intersection where the first plane and the second plane meet. In the second position, however, needles 505 pass through the intersection where the first plane and the second plane meet.

Knitting machine 500 may have a plurality of rails extending above and parallel to the intersection of needle beds 502 and 504, providing attachment points for multiple standard feeders. Each rail has two sides, each of which accommodates a standard yarn feeder. In at least one case, knitting machine has three rails, rail 530, rail 532 and rail 534 extending the length of knitting machine 500 (for purpose of this discussion, only a portion of rail 530 and rail 532 are shown in FIG. 5). As depicted, each of rail 530, rail 532 and rail 534 includes a feeder on opposite sides. As such, knitting machine 500 may include a total of six feeders, i.e. feeder 536, feeder 538, feeder 540, feeder 542, feeder 544 and feeder 546. Although three rails are depicted, further configurations of knitting machine 500 may incorporate fewer or additional rails. Consequently, knitting machine 500 may provide attachment points for fewer or additional feeder than are depicted.

Due to the action of a carriage 501, feeders 536, 538, 540, 542, 544 and 546 move along rail 530, rail 532 and rail 534, and needle bed 502 and 504, thereby supplying yarns to needles 503 and needles 505. Further, in FIG. 5, a yarn is provided to each feeder by a spool. In particular, yarn 518 is provided to feeder 546 by spool 506; yarn 520 is provided to feeder 544 by spool 508; yarn 522 is provided to feeder 542 by spool 510; yarn 524 is provided to feeder 540 by spool 512; yarn 526 is provided to feeder 538 by spool 514; and yarn 528 is provided to feeder 536 by spool 516. More particularly, yarn 518 extends from spool 506 to various yarn guides, a yarn take-back spring, and a yarn tensioner before entering feeder 546, with each of the other yarns, feeders and spools similarly configured.

Standard feeders are conventionally-utilized for a V-bed flat knitting machine, such as knitting machine 500. That is, existing knitting machines incorporate standard feeders, such as feeders 536, 538, 540, 542, 544 and 546 depicted in FIG. 5. Each standard feeder 536, 538, 540, 542, 544 and 546 has the ability to supply a yarn that needles 503 and needles 505 manipulate to knit, tuck, and float.

Knitting Process

Figure 6:
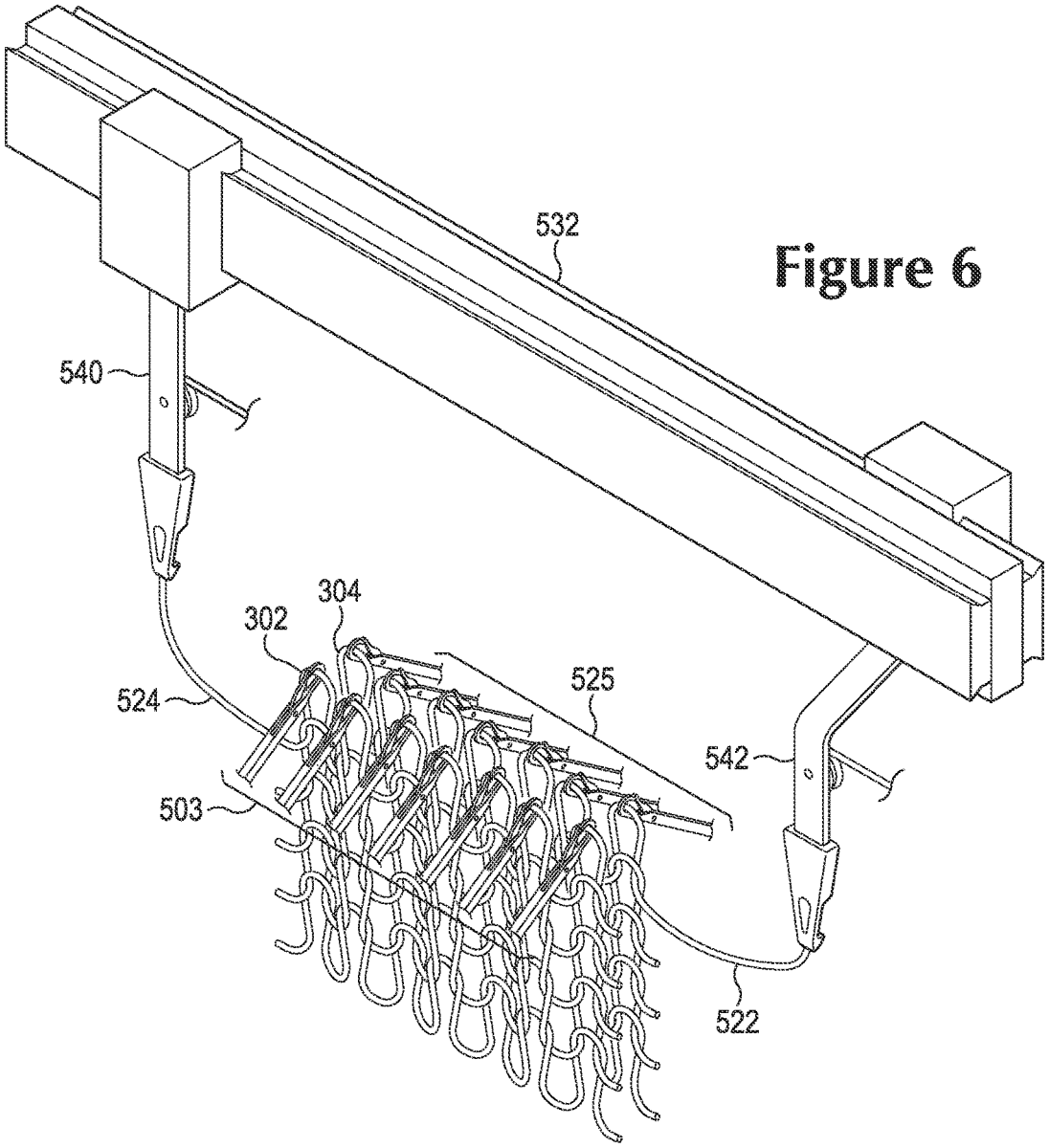
FIG. 6 is a schematic perspective view of a knitting process.

The manner in which knitting machine 500 operates to manufacture a knitted component will now be discussed in detail. In particular, the following discussion will demonstrate the manner in which knitted component run 400 may be formed of unitary knit construction. Referring to FIG. 6, a portion of knitting machine 500 is schematically-depicted as including needle beds 503 and 505, one rail 532, and two standard feeders 540 and 542. It should be understood that the general structure of knitting machine 500 is simplified for purposes of explaining the knitting process, and that portions of knitted component run 400 are depicted as being adjacent to—instead of in between—needle beds 503 and 505 to (a) be more visible during discussion of the knitting process and (b) show the position of portions of knitted component run 400 relative to each other and needle beds 503 and 505.

Figure 7:
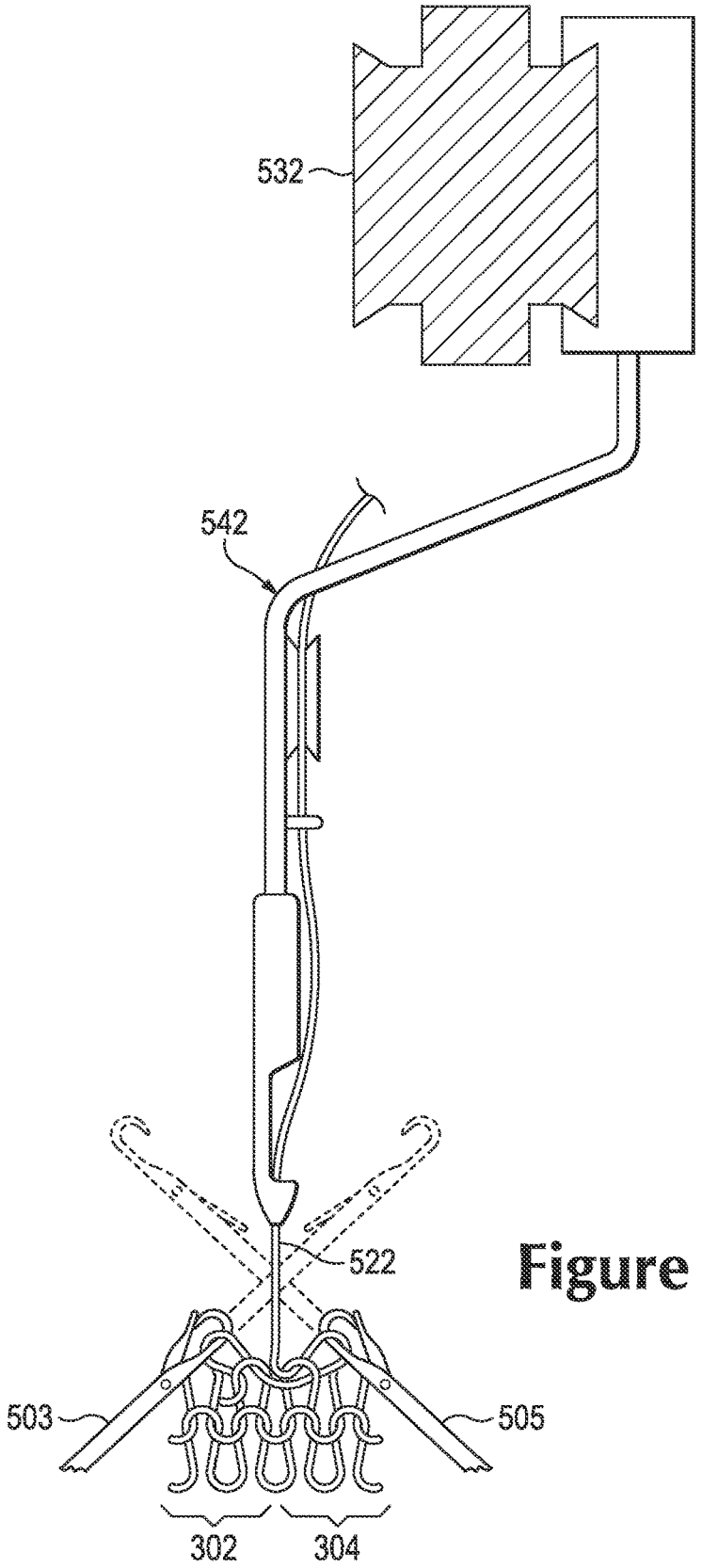
FIG. 7 is a schematic lateral side elevational view of the knitting process.
Figure 8:
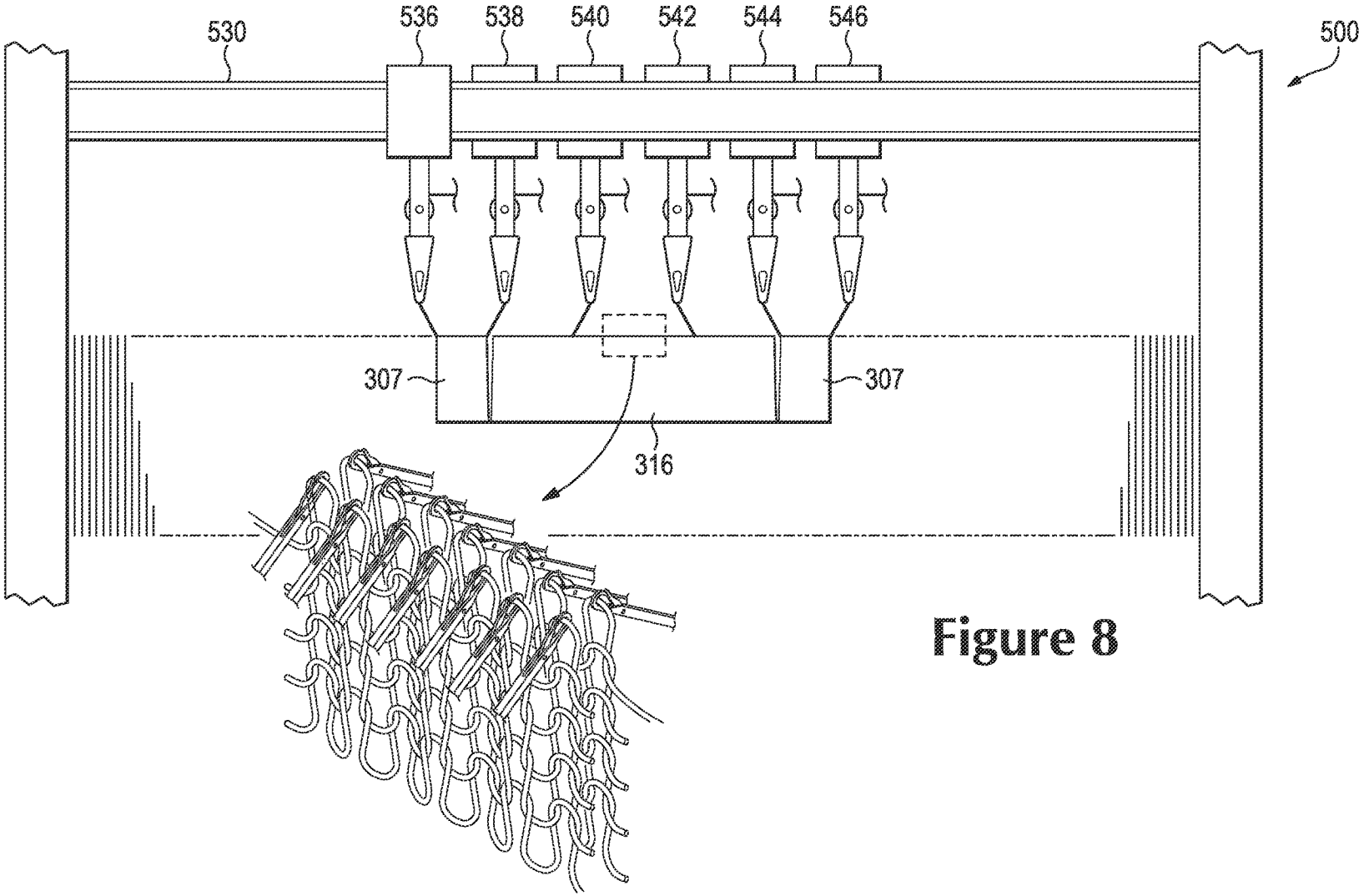
FIG. 8 is a schematic elevational and a schematic perspective view of the knitting process.
Figure 9:
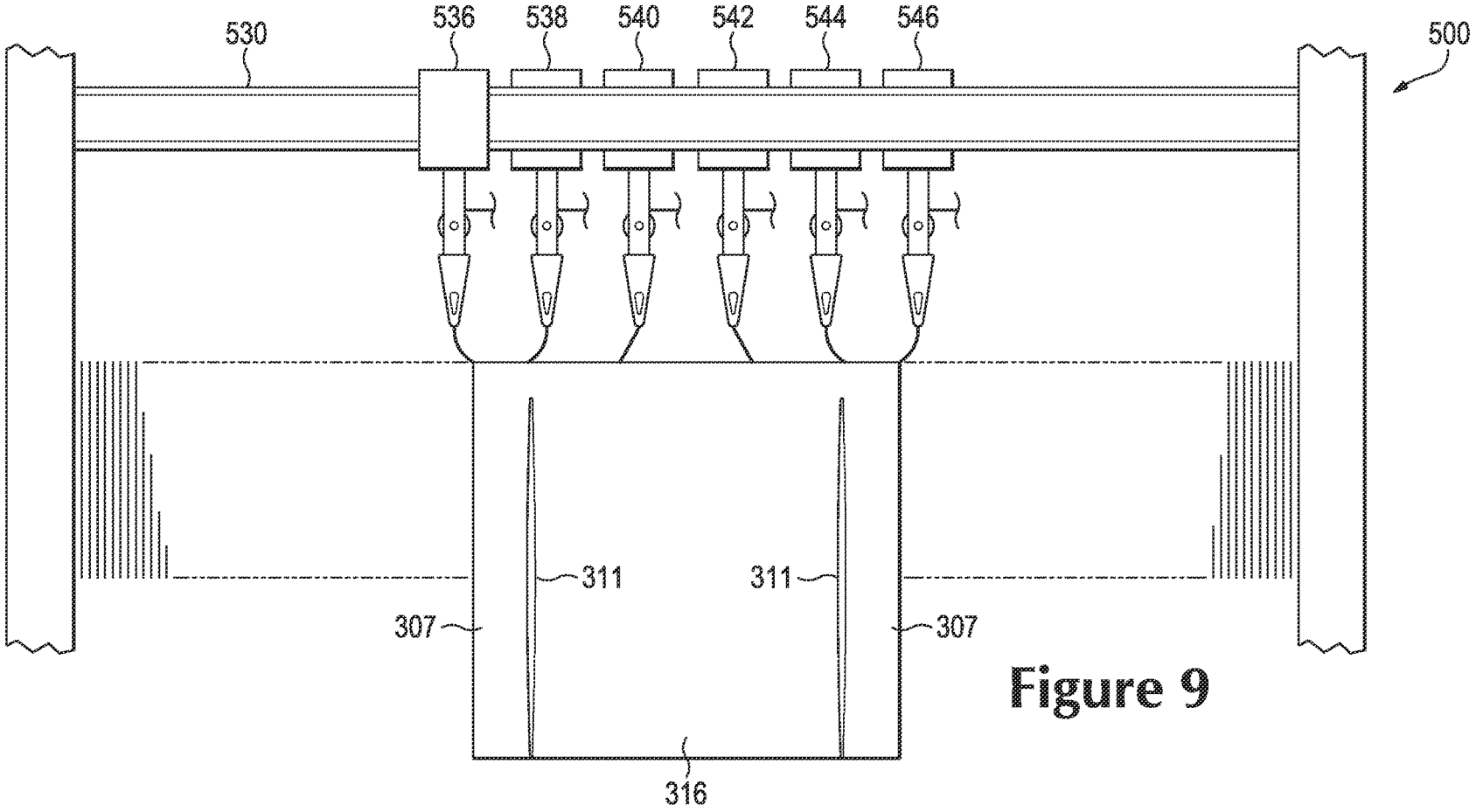
FIGS. 9-10 are additional schematic elevational views of the knitting process.
Figure 10:
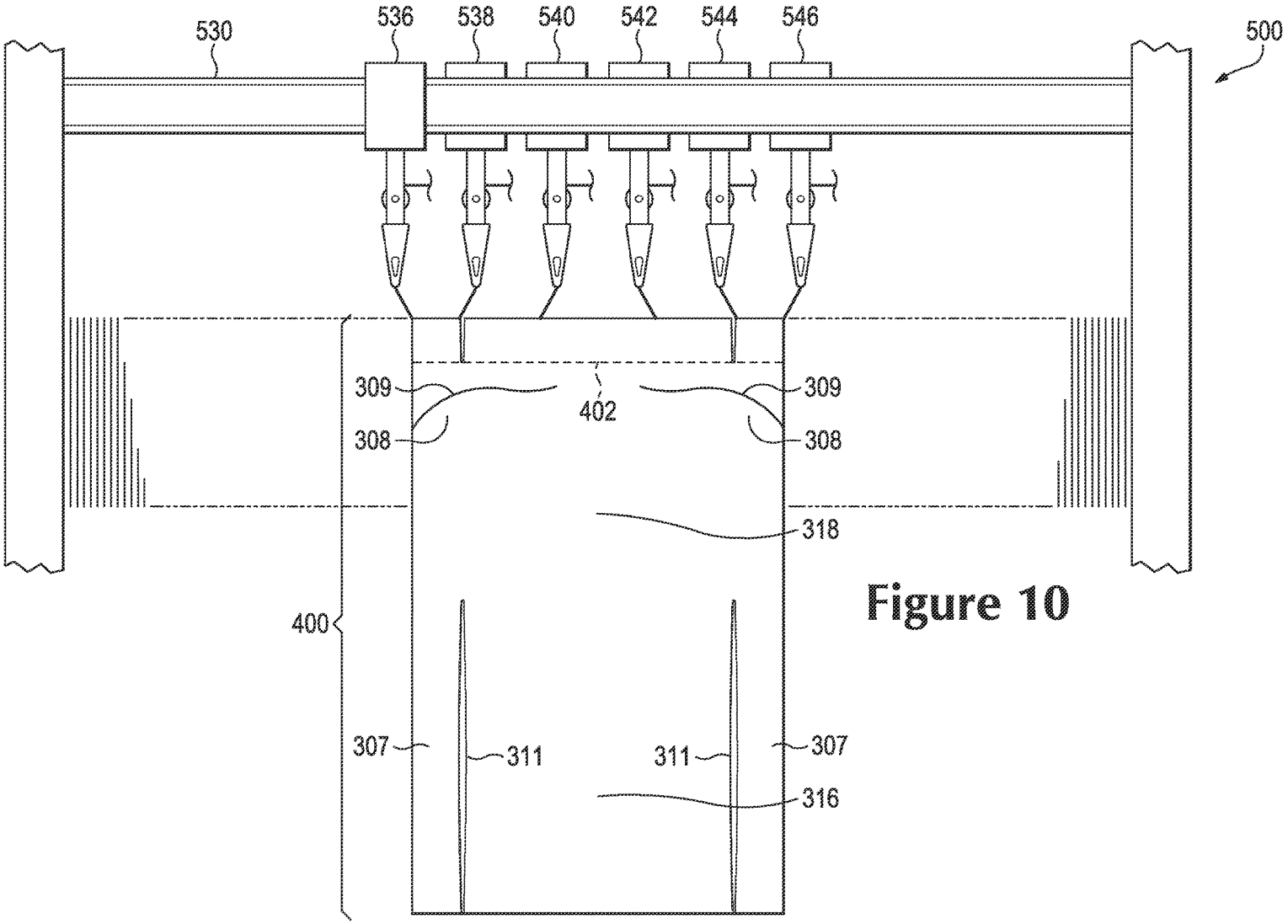

According to at least one embodiment, each of tubular elements 307 and tubular element 316 may be formed by knitting machine 500 as depicted in FIGS. 8-10. In forming this first portion of a knitted component run 400, paired feeders may be used to form the separate tubular elements 307 and tubular element 316, as well as the unitary tubular element 318. In other words, feeders 536 and 538 may form a first of the tubular elements 307 and feeders 544 and 546 may form a second of the tubular elements 307. Similarly, as best seen in FIG. 9, feeders 540 and 542 may form tubular element 316 at the same time that tubular elements 307 are being formed. As depicted in FIG. 9, after a first run of tubular elements 307 and tubular element 316 have been formed, feeders 540 and 542 may form the whole of unitary tubular element 318. More particularly, as may be seen in more detail in FIGS. 6-8, and referring specifically to the construction of center tubular element 316 by way of example only, needles 503 pull sections of yarn 524 through loops of a prior course, thereby forming another course of front portion 302. At the same time that front portion 302 is being knitted, needles 505 pull sections of yarn 522 through loops of a prior course, thereby forming another course of rear portion 304.

FIG. 7 depicts a lateral side view of the knitting process as a course of front portion 302 and rear portion 304 is completed. As described above, feeder 542 may pull sections of yarn 522 through the loops of a prior course. As depicted in FIG. 7, when feeder 542 completes one course of rear portion 304, feeder 542 may loop yarn 522 through the loops of a prior course of front portion 302 to join front portion 302 and rear portion 304. At the same time, when feeder 540 completes one course of front portion 302, feeder 540 may loop yarn 524 through the loops of a prior course of rear portion 304 to join rear portion 304 and front portion 302 at the opposite side (not shown in Figures). Tubular elements 307 may be formed at the same time and in the same manner as tubular element 316, however tubular elements 307 may utilize different feeders. As may be seen if FIG. 8, a first tubular element 307 is formed with feeders 536 and 538, utilizing yarns 516 and 514, respectively. Similarly, a second tubular element 307 is formed with feeders 544 and 546, utilizing yarns 520 and 518, respectively. As depicted, the process continues until the entirety of tubular element 316 and tubular elements 307 are substantially formed.

At this stage, knitting machine 500 now begins the process of forming singular knit element 318, eventually forming the upper and shoulder regions of a shirt 100. As the knitting process continues, standard feeders 536, 538, 544 and 546—which had been knitting tubular elements 307—may cease knitting, and standard feeders 540 and 542 may continue knitting to form unitary knit element 318 across the tops of tubular elements 307 and tubular element 316. In other words, standard feeders 540 and 542 may loop yarns 524 and 522 through the prior course of rear portion 304 and from portion 302, as described above, across the top portions of tubular elements 307 and tubular element 316. This action creates a course that is intended to join tubular elements 307 and tubular element 316 to unitary tubular element 318. This continues until singular tubular element 318 portion of knitted component 300. As may be seen in FIG. 10, additional reinforced stitches, such as densely knit courses, may be used to join portions of yarn courses of front portion 302 and rear portion 304 to create shoulder seams 308 and 309. Once a first knitted component 300 is completed, the above process continues to create multiple knit components, ultimately creating a knit component run 400, as depicted in FIG. 10 and previously discussed in relation to FIGS. 3A and 3B. It should also be noted that although tubular elements 307, 316 and 318 are depicted as being formed with six separate yarns, additional or fewer yarns may be used, as well as additional or fewer feeders.

It will be understood that various additional techniques known in the art may be incorporated into the knitting process. For example, a fusible yarn may be incorporated into one or more final courses of knitted component. By incorporating a fusible yarn into a final course of the knit structure, the interface of each knitted component 300 in the knit component run may be strengthened. That is, melting of the fusible yarn will fuse or otherwise join the sections of yarn at the interface and prevent unraveling of the cut yarn. In other cases, a fusible yarn may be incorporated into the knitting of shoulder seams 308 and 309. Thereafter, each tubular element 318 may be heated to fuse front portion 302 and rear portion 304 to create shoulder seams 308 and 309.

In addition, portions of knitted component 300 may include reinforced stitches. For example, reinforced stitches may be used between beginning and ending stitches of a singular knitted component. Such reinforcement may help prevent unraveling of the stitches when singular knitted components are separated from a knitted component run. As another example, reinforced stitches may be used to strengthen or hold together portions of a tubular knit element, such as tubular knit element 318. In at least one case, the shoulder seams 308 and 309 may include stitches with a relatively tight or dense knit to ensure fewer dropped stitches are formed.

Figure 11:
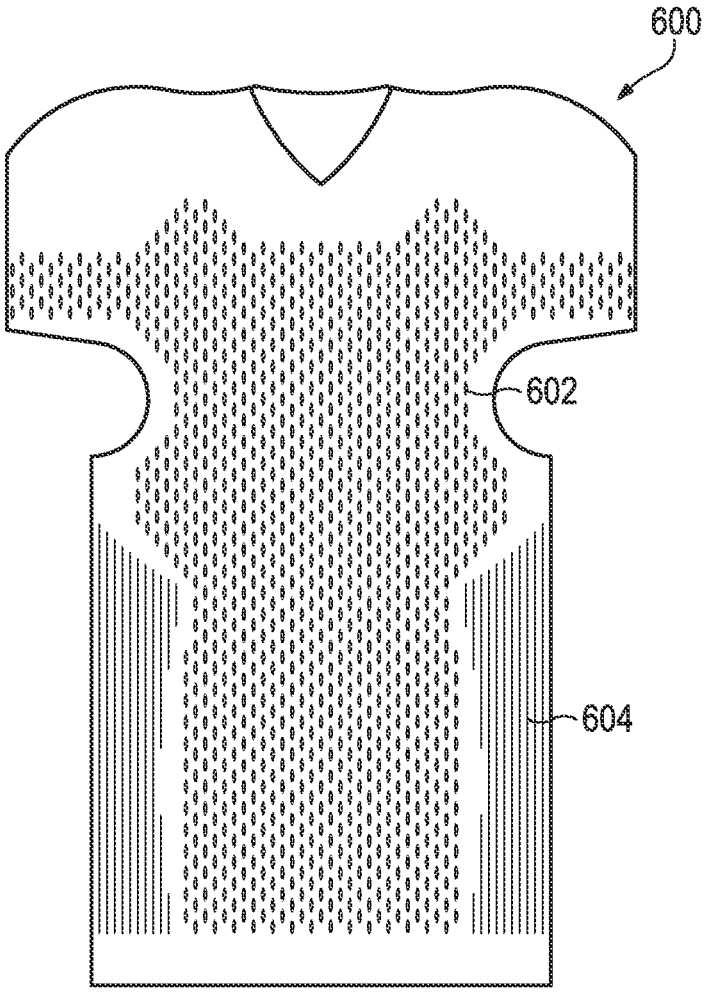
FIG. 11 is an elevational view of an article of apparel according to an additional embodiment.

It is also contemplated that a variety of different knitted stitches may be used to create various patterns and/or serve to provide enhanced properties in certain areas of a shirt produced according to techniques described herein. In some cases, stitch techniques available to a skilled artisan may be used to create patterns on portions of the knitted components to improve the aesthetic experience. In other cases, certain stitch techniques may be incorporated to enhance properties of the shirt such as stretchability, increased aeration or to create areas that may resist excess stretching. FIG. 11 depicts a shirt 600 incorporating a variety of knitting stitches according to at least one embodiment. In particular, as depicted, shirt 600 incorporates a diamond-shaped stitch element 602, which creates a diamond effect on portions of shirt 600. Diamond shaped stitch elements 602 may serve to provide additional aeration and added stretch properties in certain areas of shirt 600. Further, shirt 600 incorporates vertically enforced stitch elements 604 on at least a torso portion of shirt 600. Vertically enforced stitch elements 604 may serve to resist stretching, thereby helping shirt 600 conform more tightly to a wearer's torso.

While various embodiments of the disclosure have been described, the description is intended to be exemplary, rather than limiting and it will be apparent to those of ordinary skill in the art that many more embodiments and implementations are possible that are within the scope of the disclosure. Accordingly, the disclosure is not to be restricted except in light of the attached claims and their equivalents. Also, various modifications and changes may be made within the scope of the attached claims.

What is claimed is:

1. A method for manufacturing an article of apparel, the method comprising:

forming a first region comprised of a first tubular knit element;

forming a second region comprised of a second tubular knit element, a third tubular knit element, and a fourth tubular knit element positioned in a side-by-side arrangement, wherein a first end of each of the second tubular knit element, the third tubular knit element, and the fourth tubular knit element seamlessly extends from the first tubular knit element cutting off at least a portion of the second tubular knit element and the fourth tubular knit element to create a pair of arm holes;

cutting off a top portion of the first tubular knit element to create a pair of shoulder regions;

cutting a center portion of the first tubular knit element to create a neck hole; and joining the shoulder regions to form a pair of shoulder seams.

2. The method according to claim 1, further comprising:

forming a third region adjacent to the second region, the third region comprised of a fifth tubular knit element;

forming a fourth region comprised of a sixth tubular knit element, a seventh tubular knit element, and an eighth tubular knit element, wherein the fourth region seamlessly extends from the third region, and wherein the third region and the fourth region together form a second knit component.

3. The method according to claim 2, wherein the first knit component and the second knit component comprise at least a portion of a knitted component run including a plurality of knit components.

4. The method according to claim 2, further comprising separating the first knit component from the second knit component.

5. The method according to claim 1 wherein each shoulder seam of the pair of shoulder seams is created by joining a first front cut side of the first tubular knit element to a second back cut side of the first tubular knit element.

6. The method according to claim 1, further comprising incorporating reinforced stitches on at least a portion of the first knit component.

7. The method according to claim 1, wherein at least a portion of the first region and at least a portion of the second region includes diamond-shaped stitch elements.

8. The method according to claim 1, wherein at least a portion of the second region includes reinforced stitch elements.

9. A method of manufacturing multiple articles, the method comprising:

forming a plurality of knit components on a knitting machine, each of the plurality of knit components comprising:

a first region comprised of a first tubular knit element; and a second region comprised of a second tubular knit element, a third tubular knit element, and a fourth tubular knit element positioned in a side-by-side arrangement, wherein a first end of each of the second tubular knit element, the third tubular knit element, and the fourth tubular knit element seamlessly extends from the first tubular knit element;

separating each of the plurality of knit components into a plurality of individual knit components; and for each of the plurality of individual knit components, cutting off at least a portion of the second tubular knit element and the fourth tubular knit element to create a pair of arm holes;

cutting off a top portion at a first side and a second side of the first tubular knit element to create a respective first front cut side of the first tubular knit element and a second back cut side of the first tubular knit element;

joining the first front cut side to the second back cut side at each of the first side and the second side of the first tubular knit element to create a pair of shoulder seams; and cutting a center portion of the first tubular knit element to create a neck hole.

10. The method according to claim 9, wherein the multiple articles comprise shirt-type articles.

11. The method according to claim 9, further comprising incorporating reinforced stitches on at least a portion of each of the plurality of knit components.

12. The method according to claim 9, wherein at least a portion of each first region and at least a portion of each second region includes diamond-shaped stitch elements.

13. The method according to claim 9, wherein at least a portion of each second region includes reinforced stitch elements.

14. A method for manufacturing a football jersey, the method comprising:

forming an upper torso region comprised of a first tubular knit element;

forming a lower torso region comprised of a second tubular knit element, a third tubular knit element, and a fourth tubular knit element positioned in a side-by-side arrangement, wherein a first end of each of the second tubular knit element, the third tubular knit element, and the fourth tubular knit element seamlessly extends from the first tubular knit element;

cutting off at least a portion of the second tubular knit element and the fourth tubular knit element to create a pair of arm holes;

cutting off a top portion at a first side and a second side of the first tubular knit element to create a respective first front cut side of the first tubular knit element and a second back cut side of the first tubular knit element;

joining the first front cut side to the second back cut side at each of the first side and the second side of the first tubular knit element to create a pair of shoulder seams; and cutting a center portion of the first tubular knit element to create a neck hole.

* * * * *